United States Patent [19]

Jost

[11] Patent Number: 4,483,160

[45] Date of Patent: Nov. 20, 1984

[54] DRY CLEANING APPARATUS FOR CLEANING PIECES OF FABRIC

[76] Inventor: Walter Jost, Gollenstrasse 13, D-7300 Esslingen, Fed. Rep. of Germany

[21] Appl. No.: 449,797

[22] Filed: Dec. 14, 1982

[30] Foreign Application Priority Data

Dec. 17, 1981 [DE] Fed. Rep. of Germany ..... 3150015
Oct. 28, 1982 [DE] Fed. Rep. of Germany ..... 3239937

[51] Int. Cl.[3] ..... D06F 43/08

[52] U.S. Cl. ..... 68/18 C; 68/18 F; 34/77; 210/410

[58] Field of Search ..... 68/18 R, 18 C, 18 F; 34/77, 82; 210/410, 416.1, 456, 482, 196, 770, 771

[56] References Cited

U.S. PATENT DOCUMENTS

| | | | |
|---|---|---|---|
| 626,991 | 6/1899 | Eberhard | 210/416.1 X |
| 1,531,257 | 3/1925 | Brockett | 34/77 |
| 1,595,344 | 8/1926 | Lomax | 210/416.1 X |
| 2,019,011 | 10/1935 | Johnson | 34/77 X |
| 2,198,412 | 4/1940 | McDonald | 210/771 |
| 2,301,803 | 11/1942 | Davis | 68/18 R X |
| 2,784,843 | 3/1957 | Braunlich | 210/456 X |
| 3,029,948 | 4/1962 | McKay | 210/771 |
| 3,190,449 | 6/1965 | Muller | 210/771 |
| 4,127,486 | 11/1978 | Hein et al. | 210/410 |
| 4,358,383 | 11/1982 | Asp | 210/771 |

FOREIGN PATENT DOCUMENTS

| | | | |
|---|---|---|---|
| 222663 | 8/1962 | Austria | 210/771 |
| 1351302 | 4/1974 | United Kingdom | 68/18 R |
| 683778 | 9/1979 | U.S.S.R. | 210/416.1 |

*Primary Examiner*—Philip R. Coe
*Assistant Examiner*—Frankie L. Stinson
*Attorney, Agent, or Firm*—Flynn, Thiel, Boutell & Tanis

[57] ABSTRACT

A dry cleaning apparatus for pieces of fabric such as clothing has a tumbler drum with a washing space within it in which the clothing is firstly washed with solvent and thereafter is dried and if necessary aired. To this end the drum space with the clothing therein is firstly joined up with a solvent circulation system and then with a hot air circulation system. The solvent circulation system has a filter unit within it for cleaning the solvent and the air circulation system has an air cooler with a condensate trap and furthermore an air heater. For drying the dirt in the filter unit air is branched off from the hot air circulation system at a point downstream from the air heater so that while drying is taking place part of the hot air makes its way through the filter unit and then comes out of the filter unit and by way of a second branch duct goes back into the hot air circulation.

13 Claims, 3 Drawing Figures

DRY CLEANING APPARATUS FOR CLEANING PIECES OF FABRIC

FIELD OF THE INVENTION

The present invention relates to the dry cleaning of pieces of fabric such as clothing, and more specifically to a way of undertaking such cleaning in which the pieces of fabric are placed in a processing space, such as a tumbler drum, and are first washed with a solvent for washing and dissolving out the dirt thereon, the solvent being circulated through the clothing and through a filter outside the tumbler, whereafter the input of solvent to the tumbler is turned off, the tumbler is drained of solvent and the clothing or the like is acted upon by a second circulated fluid, that is to say hot air, so that the solvent still in the clothing is evaporated and may be recovered from the hot air current by condensation. In such a plant the dirt filter unit has to be cleaned, or the filter cartridge therein replaced, from time to time.

BACKGROUND OF THE INVENTION

In a more limited sense, the present invention has to do with a dry cleaning apparatus for use in such a cleaning process and with a cleaning plant for the dry cleaning of pieces of fabric as for example clothing, the apparatus having a processing space formed by a turning tumbler or tumbler drum which is joined up with a solvent circulation system and a hot air circulation system, whose operation takes place after that of the solvent circulation system, each such circulation system having a pump therein. Furthermore the solvent circulation system has a dirt filter, whereas the hot air circulation system has an air cooler with a condensate trap and an air heater coming after the air cooler in the direction motion of the air.

Such plant is known in the art. In such a plant or apparatus, the dirt washed out in the washing operation is kept back and taken up by the filter unit so that, dependent on the design of such unit, the filter unit has to be cleaned or the filter cartridge therein has to be taken out and a new one put in its place. In this case, in the prior art, for example in an apparatus having an "expander filter", the first step is to take out the filter cake produced, and to put it in a still vessel with the solvent from the solvent circulation system, the still forming part of a solvent processing and recovery unit so that the solvent may be recovered for further use. In the distillation process using the still, dyes and bacteria, for example, are cleared from the solvent.

However, the outcome of such processing is that the still or distillation apparatus becomes dirty so that work of disposing of the dirt is not made any simpler but only undertaken in a different part of the apparatus. In other cases in which throw-away filters, made for example of paper, are used, there are still troubles in connection with disposal of the used filter papers, inasfar as there will in all cases still be a certain amount of solvent in the dirt sticking to the filter paper so that, for safeguarding the environment, it is not possible for the filters simply to be thrown away and they have to be taken care of by special organizations as chemical waste, this being complex and expensive.

SUMMARY OF THE PRESENT INVENTION

The invention has to do with such shortcomings in the prior art and one purpose or object of the invention is that of designing an apparatus of the sort noted, which makes it possible for the dirt from the filter or the filter cartridge itself to be disposed of without undesired effects on the environment and without the filter or dirt having to be specially transported from the apparatus to some special tip for chemical waste.

A still further purpose of the present invention is to make this possible in the simplest possible way.

For effecting this purpose, and further purposes, in the present invention a first air duct is branched off from the hot air circulation system at a point downstream from the air heater, such duct running to the inlet side of the filter unit, and the outlet side of the filter unit has a second air duct running therefrom to the hot air circulation system.

With apparatus designed on these lines it becomes possible, at the time cleaning is taking place, for a part of the hot air current to be branched off from the condensing unit, and run though the filter unit, while the pieces of fabric are being dried and while the solvent is being evaporated off, with the outcome that the solvent in the filter unit and in the filtered-out dirt, is evaporated and taken along with the hot air current.

The dirt and the dirty filter cartridges no longer have to be processed as chemical waste or refuse. Because hot air is in any case "on tap" in the apparatus, the changes needed in such apparatus for putting the teaching of the invention into effect are very simple.

Further details and general teachings of the invention will be made clear using the account now to be given of one working example thereof, to be seen in the figures.

DETAILED DESCRIPTION

Figure 1:
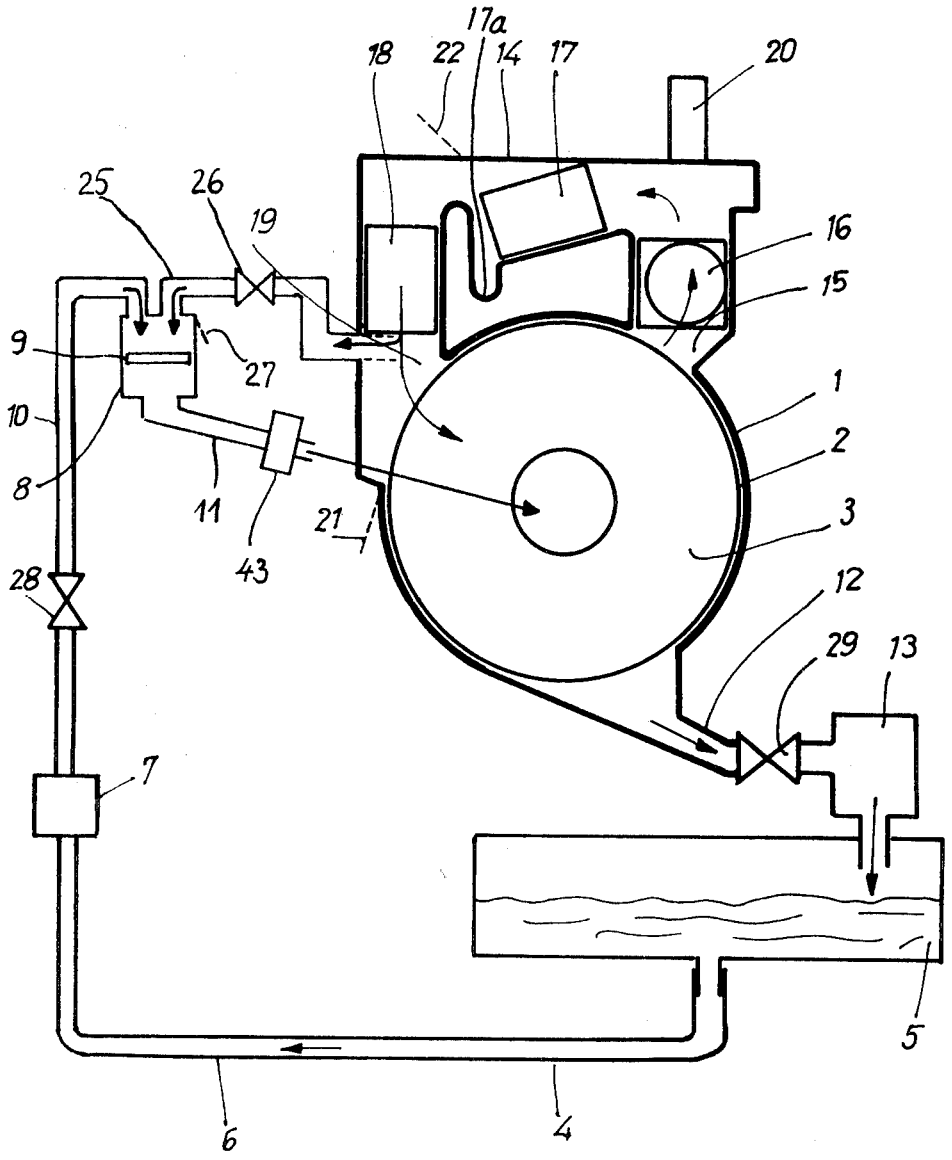
FIG. 1 is a diagrammatic side view of a dry cleaning apparatus embodying the invention.

The apparatus of FIG. 1 is used for the dry cleaning of pieces of fabric as for example clothing. In the housing 1 of the apparatus there is a tumbler or cleaning drum 2, which is supported in the housing 1 so that it may be turned about a horizontal axis and the pieces of clothing put into its inside space 3 tumbled and washed. The pieces of fabric firstly undergo a process step in which they are washed with a solvent for dissolving out and washing out the dirt in the fabric. To this end the processing space 3 is joined up with a solvent circulation system 4. This system 4 includes a solvent tank or container 5, from which the solvent is pumped by a pump 7 by way of a pipe 6. Coming out of the pump, the solvent then makes its way to a filter unit 8 with a filter cartridge or element 9 through a pipe 10 joined up with the inlet side of the filter unit 8. The solvent makes its way into the inlet side of the filter unit and goes through the filter cartridge 9, in which the dirt washed out from the clothing by the solvent is deposited. Thereafter the solvent makes its way out of the outlet of the filter unit 8 and goes through a pipe 11, forming part of the solvent circulation system, to the tumbler drum 2, into which the solvent is run axially, the solvent nextly flowing out of the drum housing 1 by way of its outlet 12 to a fluff filter 13 and then back into the tank 5.

When the washing operation has run to an end, the supply of solvent to the processing space 3 is cut off and the fabric in the drum 2 spun, the solvent centrifuged from the fabric running off into the solvent tank 5. At one and the same time the solvent makes its way out of the filter unit 8 back into the tank 5, this being by way of the pipe or duct 11 or, dependent on the special design of the system, by way of the pipe or duct 10.

The processing space 3 is joined up with a further circulation system, that is to say with a hot air circulation system, through which hot air makes its way through the drum 2 and a drum housing head 14. After the washing and spinning, the clothing in the drum 2 is acted upon by this hot air current, the rest of the solvent therein being evaporated. The hot air current comes out through a top radial outlet 15 of drum housing 1 from the processing space 3, goes through a further fluff filter 16 and then comes back into the processing space after flowing through an air cooler 17, an air heater 18 joined up with the outlet side of the air cooler 17 and a top radially pointing inlet 19. The air cooler 17 has a condensate trap 17*a* to take up the solvent condensing here out from the hot air current. The outcome is that the air, after being heated up again in the air heater, comes back into the processing or washing space in a condition free of solvent. The hot air current is produced by a second pump, which is placed in the housing head 14 between the fluff filter 16 and the air cooler 17, and of which only the motor 20 will be seen in the figure.

After this stage of the dry cleaning process the dried pieces of fabric are aired with circulated air or with air taken in from outside the dry cleaning apparatus, and to this end the drum housing 1 has a fresh air intake door 21, marked in broken lines, that is opened up after the drying operation, while the pump with motor 20 is kept turned on so that the fresh air makes its way through the outlet 15 into the head 14. Here the circulated or fresh air is moved through the fluff filter 16 and the air cooler 17 so that, once again, any solvent still in the air will be cleared from such air by condensation. The air, after this cleaning stage, is then let off to the outside by blowing through an outlet or discharge door 22 between the air cooler 17 and the air heater 18, it being clear to the reader that the door 22, like the door 21, is kept shut in the process stages coming before this part of the process.

The dirt filter unit 8 has to be cleaned from time to time or the cartridge 9 therein changed for a new one. There is however some trouble in this connection inasfar as the dirt washed out of the clothing or the like will be soaked in solvent, so that for the reason of safeguarding the environment the filter cartridge 9 may not simply be thrown away or cleaned, for example by washing it. If no special steps are taken, the dirt has to be handled as chemical waste, that is to say processed in line with special public health regulations.

In order to make this part of the process simpler, after washing, but while evaporation of the solvent out of the processing space 3 is still taking place, a part of the hot air current is branched off and ducted through the filter unit 8 so that the solvent in the collected dirt and in the filter unit, is evaporated and is cleared by the hot air current. In this respect the said part of the hot air current is tapped at a point downstream from the position at which condensation takes place, that is to say downstream from the air cooler 17, and goes to the filter unit 8. The branch point is furthermore placed downstream from the air heater 18 in the hot air circulation system, so that the clean air coming into the filter unit will be hot air. The air makes its way along an air duct 25 branching off from the head 14 of the housing and joining up with the inlet side of the filter unit 8. This air duct 25 may be shut down and is in fact shut off in the washing operation. A valve 26 is used for this purpose.

It will be seen that there is a second air duct running from the outlet side of the filter unit 8 back to the hot air circulation system so that air is ducted into the processing space 3. This second air duct is formed in the present working example by the pipe 11 running from the filter unit 8 to the space 3, such pipe forming part of the solvent circulation system and having a two-fold function: while washing is going on it is responsible for transporting the solvent, and when the washing stage has run to an end and the solvent circulation system has been turned off, the hot air current, which is branched off from the air drying the clothing to the filter for drying the same, goes through the pipe 11. In this way the filtered-out dirt is changed into a dried condition so that the filter may be simply thrown away as normal waste, or if it is question of a permanent filter, the same may be cleaned on the spot and does not have to handed over to a special organization for disposal. The drying of the dirt is a very simple operation, because generally speaking it is only necessary to make use of the air duct 25. Furthermore the prior art apparatus may be changed in its design for use in the invention quite straightforwardly. Another point is that the drying of the dirt or of the filter takes place at the same time that the clothes are being cleaned so that there is no loss of time. Once the cleaning process has run to an end, it is only necessary to take out the filter and throw it away.

In order to be quite certain that the dirt is completely freed of all solvent, it is possible in addition to let air into the filter unit 8 from the room in which the apparatus is placed, such air coming out of the filter unit 8 and making its way into the processing space 3. In the present working example of the invention this is done at the same time as the airing of the pieces of clothing or other fabric within the processing space 3, as has been detailed hereinbefore. This operation is again undertaken without causing any loss of time, and furthermore, because the circulating air is let into the processing space 3, which is acted upon by the aspirating effect of the pump with motor 20 or fan or the like, the same moving the air for ventilating the clothing in through the drum housing door 21 and driving it out again by way of the outlet door 22, no further pumps or fans or the like are necessary, and it is only necessary to have a connection, for example in the form of an intake door 27 marked in FIG. 1 in broken lines, on the inlet side of the filter unit. This door is naturally kept shut when the earlier process stages are taking place. The two air currents from the room coming in by way of the doors 21 and 27 for this reason come back into the processing space 3 and are let off therefrom by way of the door 22.

The connections for air from the room, in the form of the doors 21, 22, and 27, may be actuated at the same time as part of running of the program for the cleaning operation. It will be clear that, furthermore, the operation of the valve 26 and the operation of the two shut-off valves 28 and 29 to be seen in the figure, and any further valves and controllers that may be used, will be automatic and will not be by hand.

Figure 2:
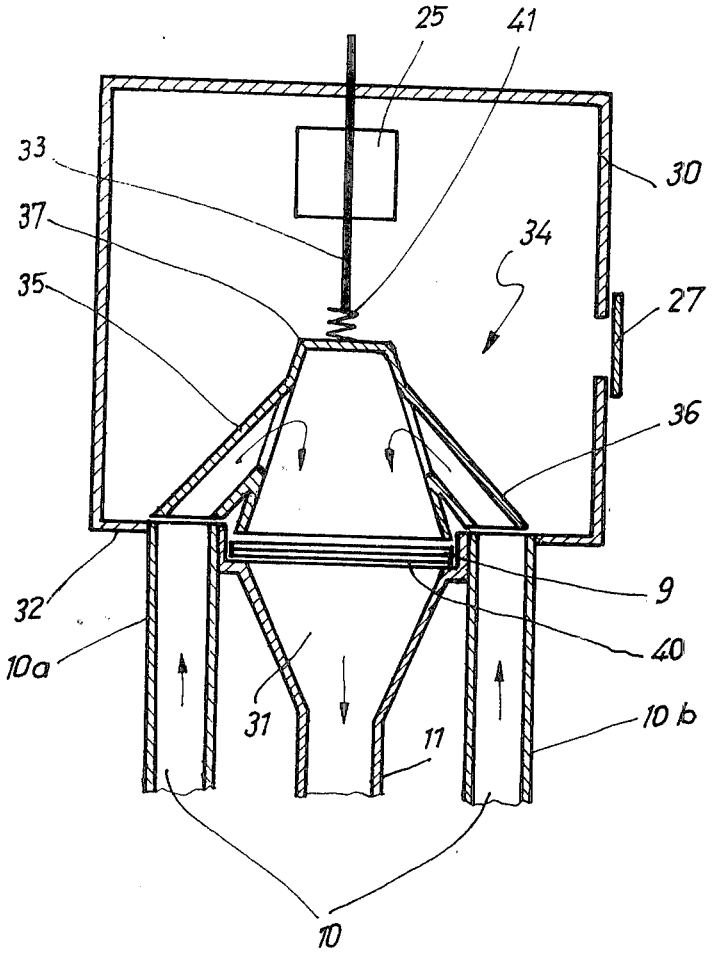
FIG. 2 is a cross section of the filter unit as used in the apparatus of FIG. 1, to make clear diagrammatically the flow of the solvent through the filter unit at the time of the washing operation.
Figure 3:
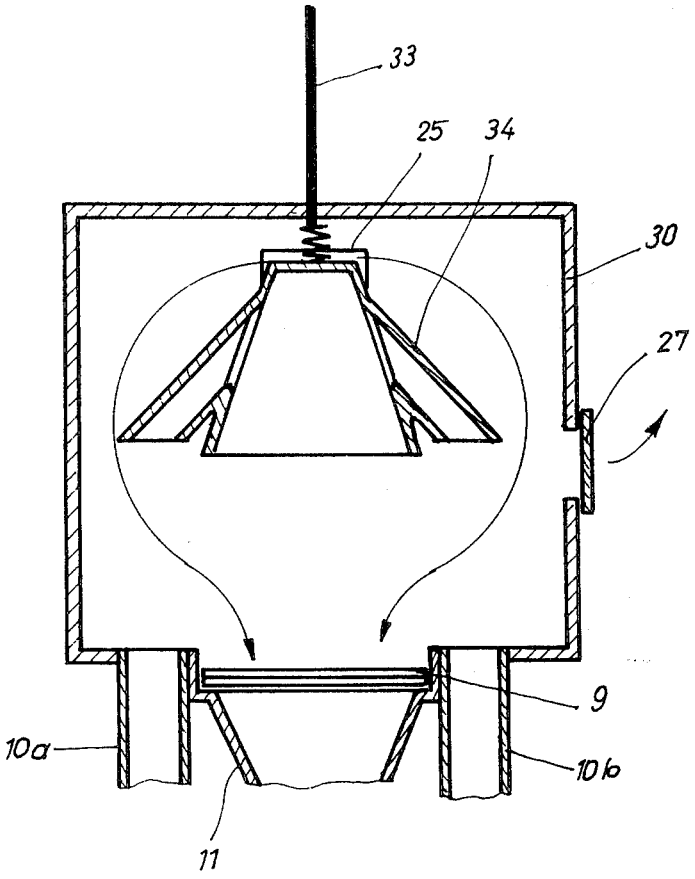
FIG. 3 is a view of the unit of FIG. 2 at the time the filter is being dried.

FIGS. 2 and 3 are views of a special form of the filter unit 8 in two possible conditions of operation. This filter unit 8 has a filter housing 30 having opening into it: the first air duct 25, the length 11 of pipe forming the second air duct and placed downstream from the filter unit 8, and furthermore the part 10 of the pipe (forming part of the solvent circulation system), that is downstream from the filter unit 8. In this respect it is only possible to see in FIG. 2 the opening of the first air duct 25 into the filter housing, the air duct 25 being placed on the backside (that is under the plane of the figure) of the housing 30. Furthermore the pipe 10 of the solvent circulation system is cut up into two legs 10*a* and 10*b*, which are in the form of hoses or pipes coming together at a point near the pump 7 and running, near the filter unit 8, on the two sides of the pipe 11 that is placed in the middle.

The filter cartridge 9, which is flat in form and has a filter plane at a right angle to the vertical and may be in the form of a paper element, is placed on the funnel-like opening end 31 of the upstream part of the pipe 11 that is part of the solvent circulation system. The ends or openings of the pipes 10 and 11 are placed on the same side of the housing 30, and in fact in the present working example of the invention are at the lower side 32 of the said housing 30 with a fixed distance between them. Furthermore the ends or openings of the two pipes 10 and 11 may be joined together and separated from each other flowwise by way of a driving part 33 which may be controlled from outside the apparatus in such a way that a connector 34 (which is fixed on the end of the driving part 33) may be moved between a position in which a channel therein provides communication between the ends of pipes 10*a*, 10*b* and 11 (see FIG. 2) and a position in which the ends of pipes 10*a*, 10*b* and 11 communicate freely with the interior of housing 30 (FIG. 3). This connector 34 is placed in the position of FIG. 2 like a cover on the two ends of the pipes 10 and 11 fluid-tightly, the seals necessary in this respect not being shown in the figure. In this position it is possible, at the time washing is taking place, for the solvent to go by way of the legs 10*a* and 10*b* of the pipe 10 into the two angled arms 35 and 36 of the connector 34, the two arms being placed each to one side of a middle bell-like part 37 and having their ends placed in alignment with the legs 10*a* and 10*b*. Coming from the arms 35 and 36 the solvent makes its way as shown by arrows into the middle part 37 by way of openings therein so that the solvent flows come together and at the open lower part, which becomes wider in downward direction, make their way to the filter cartridge 9. The solvent is filtered thereby and is then discharged through the pipe 11. The filter cartridge, which may for example be in the form of a plate, is supported on a filter grid 40, which for its part is supported on the wall of the pipe 11. The filter cartridge 9 is fixed in position by the middle part 37 of the connector 34, which is a sort of cover and is seated at the edge on the filter cartridge 9 and is pushed thereagainst.

If the outline of the filter cartridge 9 is round, a sealing effect may be simply produced by the edge thereof. (It will furthermore be clear in the present connection that the wording "flat filter cartridge" is used in the sense of a cartridge that may possibly be folded in a zig-zag form, but with the body of the cartridge mainly running in a single plane and more specially horizontally).

The driving part 33 is formed by a rod or the like stretching down through a hole in the top side of the housing 30 and being joined up resiliently with the connector 34 by a spring 41. The connector 34 is pushed against the openings or ends of the pipes 10 and 11 by way of the driving part or rod 33 or the like. In this respect the connector 34 on the lower end of the rod 33 or the like may be air powered or power-moved in some other way and controlled from the outside. The control of such motion of the driving part so as to get the connector 34 into the position to be seen in FIG. 2 or into that of FIG. 3, may be produced as part of one step of a program for controlling the apparatus.

When the filter unit is designed in this way there will be only a small amount of solvent in it so that the overall amount of solvent needed in the apparatus may be kept down.

Furthermore door 27 for air from the room is hinged on the filter housing 30, the function of the door having been made clear hereinbefore. In place of a door or flap, however, it is furthermore possible to have a short pipe-like inlet controlled by a valve.

Because the openings of the pipes 10 and 11 are placed in the floor of housing 30, the solvent will be drained off more or less completely after the solvent circulation system has been turned off.

When the washing and spinning operation has run to an end, the cover-like connector 34 is lifted into the position of FIG. 3 so that within the filter housing 30 the air duct 25 will be joined up with the pipe 11 inasfar as the hot air now will be able to make its way down through the filter cartridge 9 and the dirt sticking thereto. The hot air which at the same time is forced into the opening of the upstream pipe 10 only has the effect of forcing the solvent of the solvent circulation system back into the supply tank 5 or will be stopped by the shut shut-off valve 28 so that there will be no blow off of hot air at this point. At the time the dirt on the filter is being dried by the hot air, the door 27 (for letting in air from the room) on the filter housing 30 will be still shut. Nextly the room air door 27 is opened, and the valve 26 may be shut so that air will still go on being forced through the dirt on the filter.

Lastly it is possible, after such drying of the filter cartridge 9 (which may be made for example of filter-quality paper or specially-made non-woven fabric) has been completed, the cartridge may be taken out through a door in the filter housing 30 and thrown away. Furthermore the filter cartridge may be washed and used again.

It will be clear from FIG. 1 that a blower or other form of pump 43 may be placed in the bypass (having the filter unit 8 within it) shunting the hot air circulation system, such a blower speeding up the rate of transport of hot air through the filter unit 8. In this way it is possible to make certain of an even quicker drying of the filter cartridge, the layer of dirt thereon, or of a thick filter cake, by the air being forced through it. This blower 43 may be placed in the first air duct 25 or - as in the working example to be seen in the figure - in the second air duct or pipe, formed here by the pipe 11 (of the solvent circulation system) on the downstream side of the filter unit 8 and joining the same with the processing space 3 in the tumbler drum 2. Of these two possible line-ups, the second one may be better because it takes up less space. Furthermore in view of the room air door 27 on the inlet side of the filter unit 8, it is useful to have the blower 43 in the second air pipe or duct, inasfar as when this is so, after drying with hot air, a large amount of air from the room is aspirated in by way of the door 27.

It is furthermore possible for the blower 43 or its motor two be connected to the pump having motor 20 or the like of the hot air circulation system in such a way that the two are turned off or turned on at one and the same time. Lastly it is to be specially noted that the first air duct 25 comes to an end at the outlet of the air heater 18 and preferably ends at a location within the housing 1 of the apparatus, so that is placed as close as possible to the outlet of the heated air, that is to say at the hottest point. This is marked in broken lines in the figure.

I claim:

1. A dry cleaning apparatus for washing pieces of fabric in a dry cleaning solvent, comprising: a drum housing; a tumbler drum rotatably supported in said drum housing; a solvent filter unit; solvent circulation means for causing the solvent to flow through said drum and said filter unit; an air cooler; solvent condensate trap means for collecting solvent which condenses in said air cooler; an air heater; air circulation means for causing air to flow through said air cooler, said air heater and said drum, wherein heated air flowing through said drum effects drying of the fabric pieces therein after washing of such fabric pieces in said drum with the solvent, said solvent and air circulation means each having pumping means for respectively causing solvent and air to flow through said drum; means defining a first air duct branching off from said air circulation means at a point downstream from said air heater and running to said filter unit on an inlet side thereof; means defining a second air duct running from an outlet side of said filter unit back to said air circulation means; and means at the inlet side of said filter unit for selectively providing communication between a space within said filter unit and air external to said apparatus; wherein said filter unit includes a housing having openings which communicate with said first air duct, said second air duct, and a pipe which is a part of said solvent circulation means and is located upstream from said filter unit, said second air duct being part of said solvent circulation means; including a filter cartridge which is placed over said opening which communicates with said second air duct of said solvent circulation means; and wherein said filter unit further includes a driving part and a cover-like connector which can be moved by said driving part between a first position in which it carries fluid from said pipe of said solvent circulation means to said second air duct and seals off said pipe and second air duct with respect to the inside of said filter unit housing, and a second position in which said pipe and said second air duct freely communicate with the inside of said filter unit housing.

2. The apparatus as claimed in claim 1, wherein said openings which communicate with said pipe and said second air duct have a predetermined distance between them, and wherein said driving part is a rod which extends out through an opening in said filter unit housing.

3. The apparatus as claimed in claim 2, wherein said driving part is resiliently coupled to said connector.

4. The apparatus as claimed in claim 2, wherein said openings which communicate with said pipe and said second air duct are provided in a bottom wall of said filter unit housing, said cover-like connector being placed over said filter cartridge in said first position and acting as a cover for said filter cartridge, said filter cartridge being disposed over said opening of said second air duct and said second air duct providing communication between said filter unit and said drum housing.

5. The apparatus as claimed in claim 4, wherein said air circulation means includes a blower cooperable with said second air duct at a location between said filter unit and said drum, said blower being operatively coupled to said pumping means of said air circulation means so that they are turned on and off simultaneously.

6. A dry cleaning apparatus for washing pieces of fabric in a liquid solvent, comprising: a drum housing; a tumbler drum rotatably supported in said drum housing; a container adapted to hold a quantity of the solvent; a solvent filter unit which includes a solvent filter housing and a filter element disposed within said solvent filter housing; solvent circulation means in fluid communication with said container, said drum housing and said solvent filter housing, said solvent circulation means communicating with said solvent filter housing on an inlet side and on an outlet side of said filter element and including first means for causing solvent from said container to flow through said drum housing and said solvent filter housing during a first phase of operation of said apparatus, the solvent flowing through said solvent filter housing passing through said filter element therein from said inlet side to said outlet side thereof; an air cooler; means cooperable with said air cooler for collecting solvent which condenses therein from air flowing therethrough; an air heater; and air circulation means communicating with said air cooler, said air heater and said drum housing, wherein said air circulation means includes second means for causing air to flow during a second phase of operation subsequent to said first phase from said drum housing through said air cooler and said air heater and back into said drum housing, said air circulation means further communicating with said solvent filter housing on said inlet side and on said outlet side of said filter element and including means for causing air to flow during said second phase of operation from a location immediately downstream of said air heater to said solvent filter housing on said inlet side of said filter element, through said filter element from said inlet side to said outlet side thereof, and from said solvent filter housing on said outlet side of said filter element to said drum housing.

7. The apparatus according to claim 6, wherein said air circulation means includes means actuable during a third phase of operation subsequent to said second phase for introducing fresh air from a location external to said apparatus into said drum housing and into said solvent filter housing on said inlet side of said filter, said fresh air supplied to said solvent filter housing flowing through said filter element from said inlet side to said outlet side thereof and then flowing from said solvent filter housing into said drum housing; and wherein said air circulation means includes means for discharging said fresh air to a location external to said apparatus after said fresh air flows through said drum housing.

8. The apparatus according to claim 7, wherein said means for introducing fresh air into said drum housing and said solvent filter housing includes means defining an intake opening in said drum housing, means defining an intake opening in said solvent filter housing on said inlet side of said filter element, and means defining a movably supported door in the region of each said intake opening which can be selectively moved between a position in which the associated intake opening is obstructed and a position in which the associated intake opening is free from obstruction; and wherein said means for discharging fresh air to a location external to said apparatus includes means defining a discharge opening in said air circulation means at a location downstream of said air cooler, and means defining a movably supported door in the region of said discharge opening which can be selectively moved between a position in which said discharge opening is obstructed and a position in which said discharge opening is free from obstruction.

9. The apparatus according to claim 7, including a first duct which provides fluid communication between said solvent filter housing on said outlet side of said filter element and said drum housing, said first duct being a part of said solvent circulation means and a part of said air circulation means, wherein solvent flows through said first duct during said first phase of operation and air flows through said first duct during said second and third phases of operation.

10. The apparatus according to claim 9, including means defining a blower operatively coupled to said first duct for facilitating the flow of air therethrough during said second and third phases of operation.

11. The apparatus according to claim 9, wherein said solvent circulation means includes a second duct which communicates with said solvent filter housing on said inlet side of said filter element, said solvent circulation means supplying solvent to said solvent filter housing through said second duct during said first phase of operation; wherein said air circulation means includes a third duct which communicates with said solvent filter housing on said inlet side of said filter element, said air circulation means supplying air to said filter housing through said third duct during said second phase of operation; and including selectively actuable means for obstructing fluid flow through said second and third ducts during said third phase of operation.

12. The apparatus according to claim 11, wherein said solvent filter housing includes means defining first, second and third openings therein which respectively communicate with said first, second and third ducts, said first and second openings being provided in a bottom wall of said filter housing and said filter element extending across said first opening; and including a connector member supported within said filter housing for movement between a first position sealingly engaging said bottom wall of said solvent filter housing in a region surrounding said first opening therein and in a region surrounding said second opening and a second position spaced from said first and second openings in said bottom wall, said connector member having means defining a channel therein which provides fluid communication between said first and second openings when said connector member is in said first position.

13. The apparatus according to claim 12, wherein said solvent filter housing has two said second openings in said bottom wall which are provided on diametrically opposite sides of said first opening, said connector member sealingly engaging said bottom wall around each of said second openings and said channel in said connector member providing fluid communication between each said second opening and said first opening when said connector member is in said first position; wherein an end of said first duct adjacent said solvent filter housing diverges in a direction toward said solvent filter housing; and wherein a portion of said channel in said connector member adjacent said first opening diverges toward said first opening.

* * * * *